US006599611B1

(12) United States Patent
Hall

(10) Patent No.: US 6,599,611 B1
(45) Date of Patent: Jul. 29, 2003

(54) METHOD OF MAKING A COMPOSITE STRUCTURE

(76) Inventor: Alethea Rosalind Melanie Hall, Plot 40, Dawn Farm, Driefontein, 1747, Muldersdrift (ZA)

( * ) Notice: Subject to any disclaimer, the term of this patent is extended or adjusted under 35 U.S.C. 154(b) by 0 days.

(21) Appl. No.: 09/701,595

(22) PCT Filed: May 28, 1999

(86) PCT No.: PCT/IB99/00967

§ 371 (c)(1),
(2), (4) Date: Nov. 30, 2000

(87) PCT Pub. No.: WO99/63167

PCT Pub. Date: Dec. 9, 1999

(30) Foreign Application Priority Data

Jun. 1, 1998 (ZA) ..... 98/4685

(51) Int. Cl.[7] ..... B32B 3/12

(52) U.S. Cl. ..... 428/117; 428/116; 52/793.1; 52/793.11; 405/43; 405/49

(58) Field of Search ..... 428/117, 116; 52/793.1, 793.11; 405/43, 49

(56) References Cited

U.S. PATENT DOCUMENTS 3,379,221 A * 4/1968 Harry et al.
6,199,334 B1 * 3/2001 Malloy

FOREIGN PATENT DOCUMENTS

| | | |
|---|---|---|
| EP | 0889173 | 7/1999 |
| WO | WO9736057 | 2/1997 |

* cited by examiner

*Primary Examiner*—Deborah Jones
*Assistant Examiner*—Wendy Boss
(74) *Attorney, Agent, or Firm*—Ladas & Parry

(57) ABSTRACT

A method of making a composite structure from a support structure or a plurality of support structures laid side-by-side on a base, is disclosed. The support structure is formed from frameworks each comprising a tube of a flexible material divided by dividing walls of a flexible material into an array of compartments. The frameworks are then filled with a suitable filler material. The frameworks have compartments with three different sizes which have advantages in the construction of certain composite structures.

15 Claims, 3 Drawing Sheets

50

88
84
80
56
86
54
76
82
72
68
78
74
64
70
52
66
66A
60
62
58

100
102

METHOD OF MAKING A COMPOSITE STRUCTURE

BACKGROUND TO THE INVENTION

THIS invention relates to a method of forming a composite structure from a support structure or a plurality of support structures on a base, and to an article for use in forming such a support structure.

It is well known to form composite or support structures such as roadways, canal or river or bank linings, mine packs, sea walls or the like, from a material having a honeycomb structure, i.e having a plurality of compartments or cells divided by dividing walls, each compartment or cell being filled with a suitable filler material. Examples of such materials for use in the support structures are Hyson-Cells from M & S Technical Consultants and Services (Pty) Limited, Geoweb from Presto Products Co, Tenweb from Tenax Corp, Armater from Crow Company, Terracell from Webtec Inc, Envirogrid from Akzo Nobel Geosynthetics Co and Geocells from Kaytech.

All these materials have a common feature that the size of the compartments or cells in the material is the same. In other words, in any sheet of the material, all the cells or compartments in that sheet have the same size. There are however applications where it would be useful to have a material of this type with compartments of different sizes.

SUMMARY OF THE INVENTION

According to a first aspect of the invention there is provided a method of making a composite structure from a support structure or a plurality of support structures laid side-by-side, on a base, each support structure being formed from a framework comprising a tube of a flexible material divided by dividing walls of a flexible material into an array of compartments or cells running the length of the tube, the compartments being arranged in rows and columns so that the tube divided by dividing walls has a honeycomb structure, which method includes the steps of:

(a) locating a framework or a plurality of frameworks side-by-side, on the base;

(b) filling some or all of the compartments with a filler material;

which is characterised in that either at least one framework includes compartments with two different sizes or in that at least two adjacent frameworks have compartments of different sizes, the size of a compartment being the cross-sectional area thereof at right angles to the axis of the compartment.

In one embodiment of the invention, a composite structure is formed from a single support structure or from a plurality of support structures, wherein each support structure is formed from a framework which includes compartments with two different sizes.

In this case, each framework preferably includes one or more rows of compartments with a first size and one or more rows of compartments with a second size.

There may also be a row of compartments with a transitional size between the last row of compartments with the first size and the first row of compartments with the second size.

Preferably, the compartments with the second size are a quarter of the size of the compartments with the first size.

Each framework may also include one or more rows of compartments with a third size, the compartments with the third size being a quarter of the size of the compartments with the second size, and so on, with each succeeding set of compartments with a lesser size being one quarter of the size of the preceding compartments.

In a further embodiment of the first aspect of the invention, the composite structure may be formed from a plurality of support structures, each support structure being formed from a framework, wherein at least two adjacent frameworks have compartments of different sizes. In other words, a first framework will have compartments of a first size and an adjacent framework will have compartments of a second size.

Preferably, the compartments of one framework are a quarter of the size of the compartments of the adjacent framework.

In this case, every second smaller compartment may be joined to a respective larger compartment, every other smaller compartment being joined by a brace to the adjacent framework at a point where two larger compartments are joined.

The framework, i.e the tube and the dividing walls, may be made from any suitable flexible material. Although the material must possess some degree of flexibility, the degree of flexibility may range from very flexible up to semi-rigid. The flexible material may be for example a plastics material such as for example a co-extruded or a biaxially extruded plastics material; a plastics laminate material such as for example a laminate of a plastics material and a metallic material or a textile material; a metallic material; a woven or non-woven textile material; a paper or cardboard material; and the like. The flexible material is preferably a suitable plastics material.

The framework may include a plurality of holes therethrough to permit drainage of any liquid substance through the holes and from the framework.

The framework may have any suitable height and any suitable compartment size, provided of course that in any support structure or composite structure formed, there is included compartments of at least two sizes. For example, the height of the framework may range from 2 mm to 10 m inclusive, and each compartment may have a wall length of from 5 mm up to 2 m.

In addition, within a particular framework or in adjacent frameworks, the heights of the compartment walls may vary, so that a first compartment adjacent a second compartment may extend beyond the second compartment, either at the top or at the bottom.

The compartments in the framework may have any suitable cross-section, such as square, hexagonal or octagonal, but preferably have a square cross-section, i.e each compartment is defined by four walls of substantially equal lengths.

The filler material may be any suitable filler material, depending on the nature of the composite structure to be formed. For example, when the composite structure to be formed is a roadway or a paved area, a lining for a canal, river, drain or spillway or the like, a support for an embankment, or a dam or harbour wall, then the filler material may be an inert filler material, .e.g sand or gravel or the like, or a composition comprising a filler material and a settable binder therefor. Examples of such compositions include:

(i) an inert filler material such as sand or gravel or the like, and a cementitious binder, for example ordinary Portland Cement;

(ii) an inert filler material such as sand or gravel or the like and a bituminous binder;

(iii) a filler material such as soil treated with a suitable chemical composition such as calcium chloride, a lignin sulphonate or an ionic liquid to cause the soil to bind or set;

(iv) a filler material such as sand or gravel or the like and a resin binder, for example (a) a thermosetting resin such as polyurethanes and polyesters, (b) a thermoplastic resin such as polyethylene, EVA, or PVC, and (c) a suitable wax.

The settable composition may include a conventional foam or foaming agent so that the final set composition is a foamed composition, to reduce the weight thereof.

Alternatively, when the composite structure is a purification pack or the like, for example for the purification of liquids such as water, or gasses, then the filler material may be any material suitable for purification, e.g diatomaceous earth, an ion exchange resin or the like.

In the method of the invention, the framework or frameworks may be supported in position by the use of flexible strings or rigid stays as is disclosed in a co-pending patent application. In addition, the wall or walls of each compartment in a framework may include one or more hollow protrusions or one or more hollow recesses so that the compartments protrude into or are protruded into by adjacent compartments to interlock adjacent compartments, as is disclosed in a further co-pending patent application.

According to a second aspect of the invention there is provided a framework comprising a tube of a flexible material divided by dividing walls of a flexible material into an array of compartments or cells running the length of the tube, the compartments being arranged in rows and columns so that the tube divided by dividing walls has a honeycomb structure, wherein the framework includes compartments with two different sizes, the size of a compartment being the cross-sectional area thereof at right angles to the axis of the compartment, the framework being for use in making a support structure on a base.

DESCRIPTION OF EMBODIMENTS

The invention will now be described in more detail with reference to the accompanying drawings.

Figure 1:
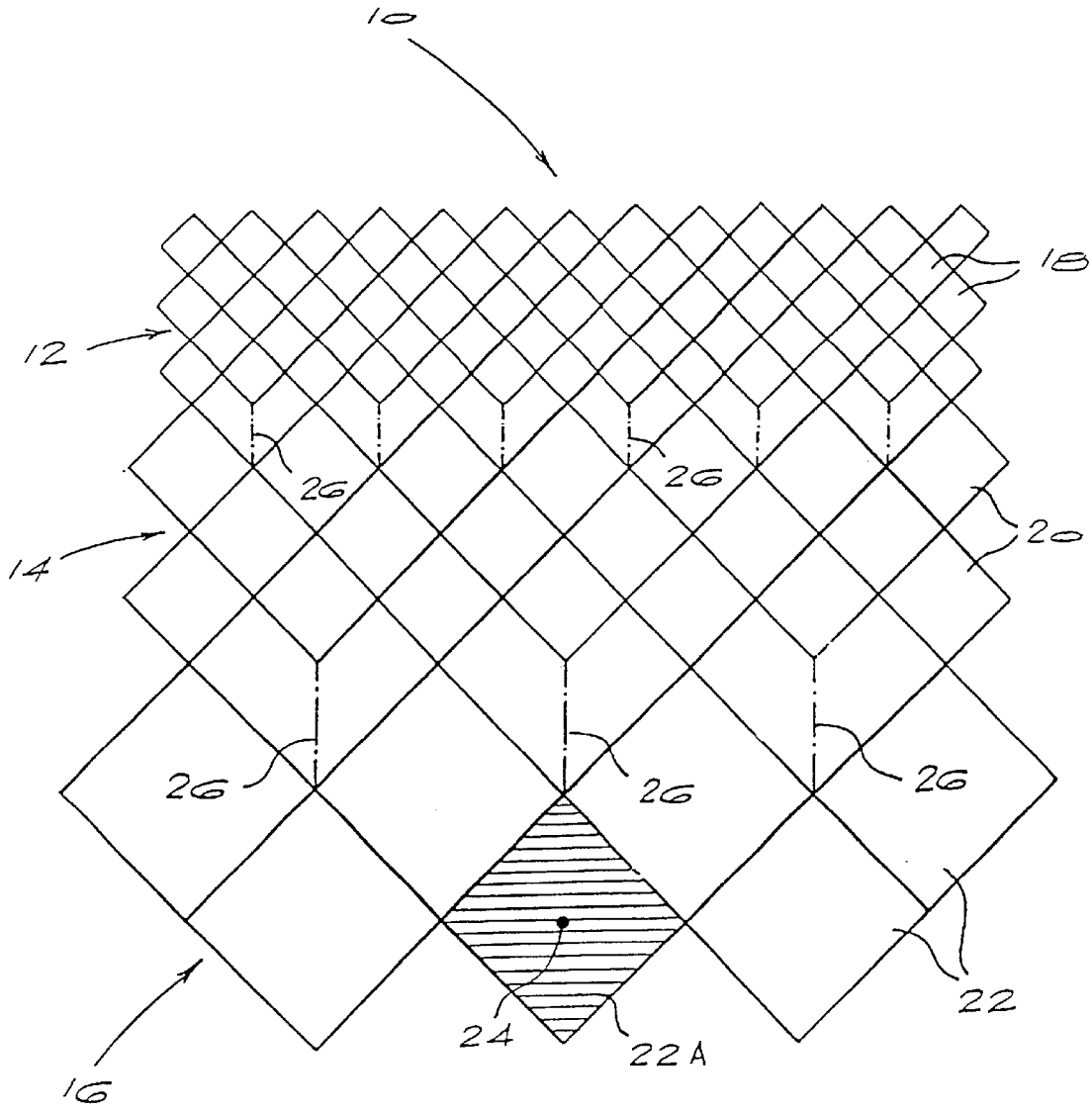
FIG. 1 is a plan view of a first composite structure according to the invention.

Referring to FIG. 1, a composite structure 10 consists of three frameworks 12, 14 and 16 laid side-by-side. The compartments 18 of framework 12 are a quarter of the size of the compartments 20 of the framework 14 which, in turn, are a quarter of the size of the compartments 22 of the framework 16.

As indicated above, by size there is meant the cross-sectional area of the compartment at right angles to the axis of the compartment. This is illustrated in FIG. 1 where the area of the compartment 22A is illustrated by cross-hatching, and the axis of the compartment 22A is indicated by a dot marked 24.

This composite structure 10 is believed to be more economical where equal performance is not required uniformly across the whole structure. For example, a first framework with smaller compartments may be stronger than a second framework with larger compartments, but also costs more. Thus the first framework should be used only where needed.

In order to join the respective frameworks 12, 14, and 16 together, every second smaller compartment is joined to an opposed, respective larger compartment. The remaining smaller compartments are joined via respective bracing strips 26 of a flexible material to a point where two adjacent larger compartments are joined.

As indicated above, flexible strings or rigid stays (not shown) may be used to support the respective frameworks in position and to hold them down onto the base, prior to being filled with the filler material.

Once the frameworks 12, 14, 16 are in position on a base, the compartments 18, 20, 22 may be filled with a suitable filler material to form the composite structure 10.

Figure 2:
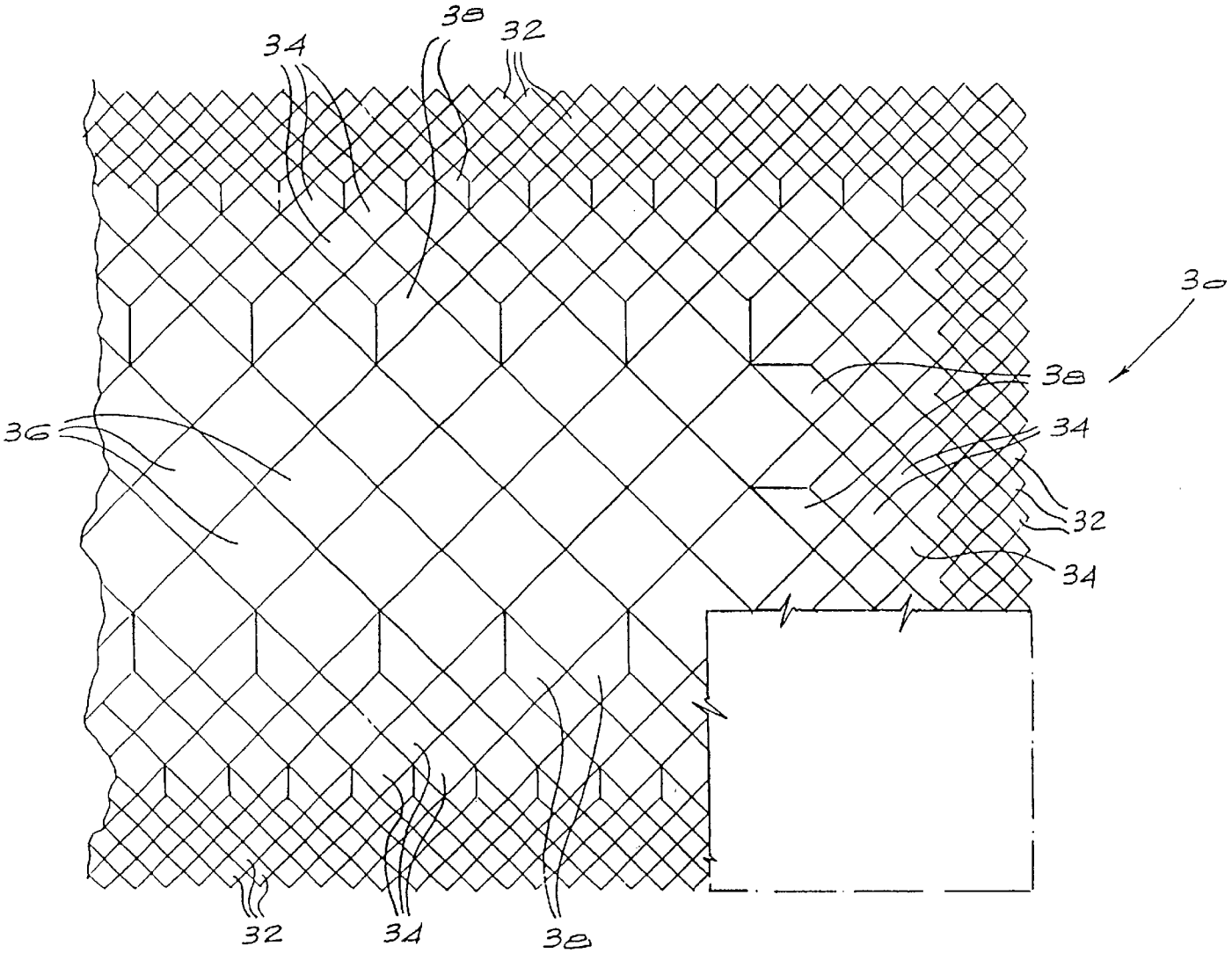
FIG. 2 is a plan view of a second composite structure according to the invention.

Referring to FIG. 2, a composite structure 30 consists of a single framework including compartments of various different sizes. The section of the composite structure 30 which is broken away is designed to illustrate the fact that the composite structure 30 may be of any desired width or length. The compartments 32 in the lines around the edge of the composite structure 30 have a first size a; the compartments 34 in the lines adjacent the lines of compartments 32 have a second size b which is four times the size a of the compartments 32; and the compartments 36 in the centre of the composite structure 30 have a size c which is four times the size b of the compartments 34.

In addition, between the lines of compartments 32, 34 and 36, there are compartments 38 with a transitional size, between the size of the compartments 32 and the compartments 34, and the compartments 34 and the compartments 36 respectively.

Again the compartments 32, 34, 36, 38 are filled with a suitable filler material to form the composite structure 30.

From FIG. 2 it can be seen that a single framework including compartments 32, 34 and 36 of three different sizes, can be utilised to form a composite structure 30.

Figure 3:
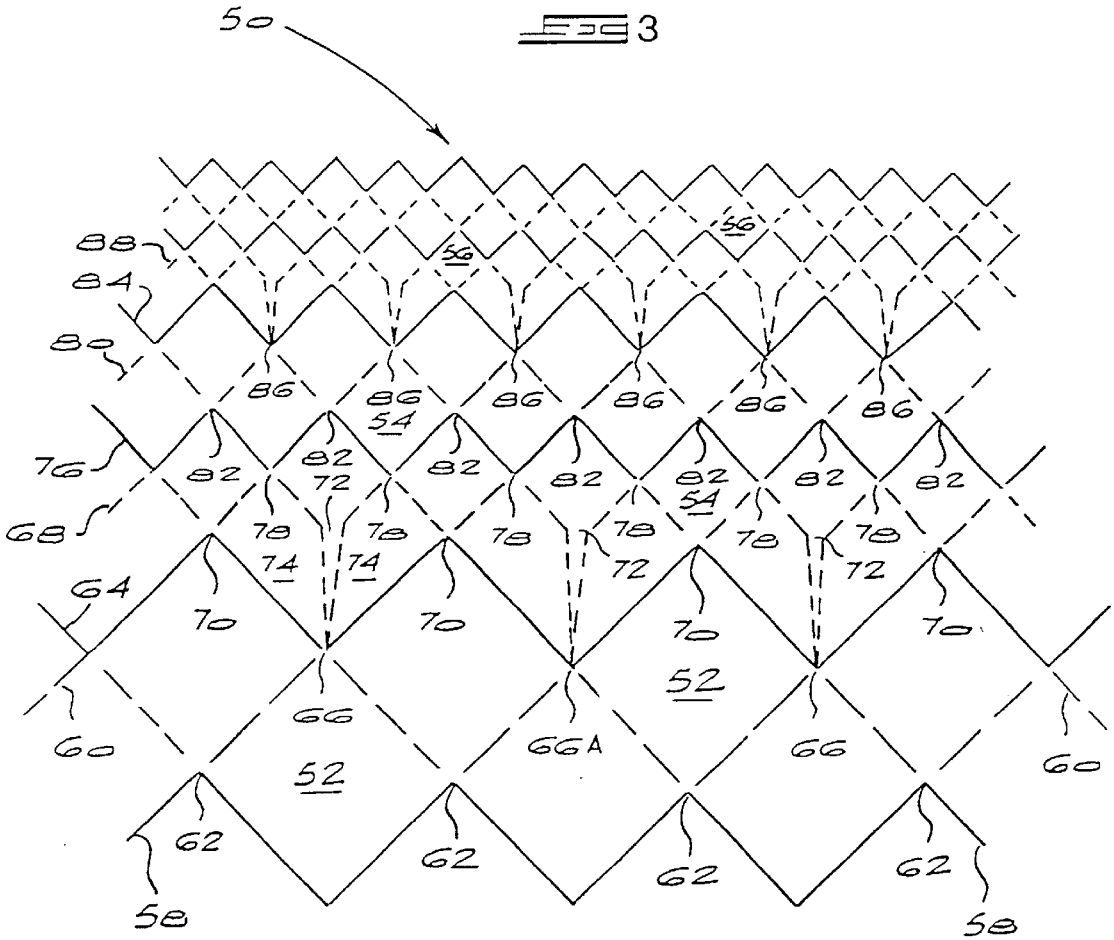
FIG. 3 is a schematic view illustrating a method of making a framework for use in the method of the invention.

Referring to FIG. 3 a method of making a single framework 50 including compartments of three different sizes 52, 54, 56 is illustrated. The framework 50 is made from lengths of a suitable material such as a plastics material, with alternating lengths being indicated by solid lines or by dotted lines.

A first length 58 of material is joined to a second length 60 of material at join points 62. Thereafter a third length 64 of material is joined to the second length 60 at join points 66, thus creating the first two rows of compartments 52 having the largest size. A fourth length 68 is then attached to the third length 64 as follows. Firstly, the fourth length 68 is folded in half and is joined along the fold line to the third sheet 64 at a central join point 66A. Thereafter, the fourth length 68 is attached to the third length 64 at join points 70 adjacent the join point 66A. Then in a similar manner the fourth length 68 is attached to the third length 64 along a double fold at the join points 66 and then again to the third length 64 at join points 70. Although FIG. 2 shows a gap between the folded portions of the fourth length 68, in practice, the fourth length 68 will he attached to itself at points 72, to form compartments 74 which are transitional compartments between the compartments 52 and the compartments 54.

Thereafter a fifth length 76 is attached at join points 78 to the fourth length 68, a sixth length 80 is attached to the fifth length 76 at join points 82, and a seventh length 84 is attached to the sixth length 80 at join points 86, to form the compartments 54.

The eighth length 88 is attached to the seventh length 84 in the same way that the fourth length 68 is attached to the third length 64, again to reduce the compartment size as is illustrated.

In this way, a single framework having compartments of varying sizes may be formed.

Figure 4:
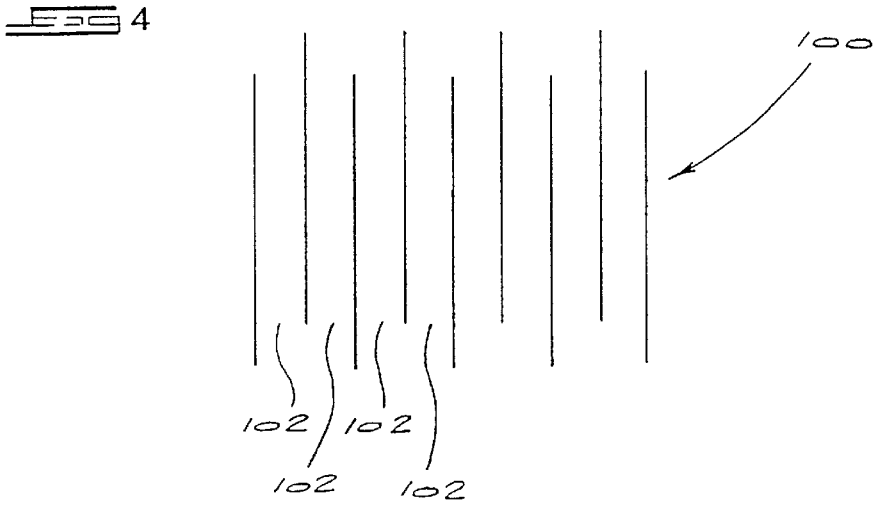
FIG. 4 is a schematic side view of a further framework for use in the method of the invention.

Referring to FIG. 4, there is shown a schematic side view of a framework 100 for use in the method of the invention, wherein adjacent compartments 102 have different heights and depths. This is useful where the framework 100 is intended to be used in a purification pack or the like.

As indicated above, the frameworks for use in the method of the invention may be made of any suitable material, and may include holes to permit the ingress or egress of liquids therethrough.

The method of the invention allows the utilization of a framework or frameworks with compartments of different sizes, so as to optimize the benefits afforded by the particular size of compartments. As indicated above smaller compartments are stronger but more expensive to manufacture and thus are used only where strength is required. These smaller compartments may abut larger compartments, which are not as strong, but which are used where great strength is not required. In addition, a framework with smaller compartments may be cut at a steeper angle than a framework with larger compartments which is useful in certain circumstances.

What is claimed is:

1. A method of making a composite structure from a support structure, on a base, the support structure being formed from a framework comprising a tube of a flexible material divided by dividing walls of a flexible material into an array of compartments running the length of the tube, the compartments being arranged in rows and columns so that the tube divided by dividing walls has a honeycomb structure, which method includes the steps of:

(a) locating the framework on the base;

(b) filling some or all of the compartments with a filler material;

wherein the framework includes compartments of a first compartment size and a second compartment size and the compartments of the second compartment size are a quarter of the size of the compartments of the first compartment size, the size of a compartment being the cross-sectional area thereof at right angles to the axis of the compartment.

2. A method according to claim 1 wherein the composite structure is formed from a single support structure or from a plurality of support structures, wherein each support structure is formed from a framework which includes compartments with two different sizes.

3. A method according to claim 2 wherein each framework includes one or more rows of compartments with the first compartment size and one or more rows of compartments with the second compartment size.

4. A method according to claim 3 wherein the framework includes a row of compartments with a transitional size between a last row of compartments with the first compartment size and a first row of compartments with the second compartment size.

5. A method according to claim 3 wherein each framework includes one or more rows of compartments with a third compartment size, the compartments with the third compartment size being a quarter of the size of the compartments with the second compartment size, and the compartments with the second compartment size being one quarter of the size of the compartments with the first compartment size.

6. A method according to claim 2 wherein the compartments of each framework have a square cross-section.

7. A method of making a composite structure from a plurality of support structures laid side-by-side, on a base, each support structure being formed from a framework comprising a tube of a flexible material divided by dividing walls of a flexible material into an array of compartments running the length of the tube, the compartments being arranged in rows and columns so that the tube divided by dividing walls has a honeycomb structure, which method includes the steps of:

(a) locating the plurality of frameworks side-by-side on the base;

(b) filling some or all of the compartments with a filler material;

wherein at least two adjacent frameworks have compartments of different sizes, the size of a compartment being the cross-sectional area thereof at right angles to the axis of the compartment;

wherein in two adjacent frameworks having compartments of different sizes, the compartments of a first adjacent framework are a quarter of the size of the compartments of the second adjacent framework.

8. A method according to claim 1 or 7 wherein each framework is made from a flexible material selected from the group consisting of a plastics material, a plastics laminate material, a metallic material, a woven or non-woven textile material, and a paper or cardboard material.

9. A method according to claim 1 or 7 wherein each framework includes a plurality of holes therethrough to permit drainage of an liquid substance through the holes and from the framework.

10. A framework comprising a tube of a flexible material divided by dividing walls of a flexible material into an array of compartments running the length of the tube, the compartments being arranged in rows and columns so that the tube divided by dividing walls has a honeycomb structure, wherein the framework includes compartments of a first compartment size and a second compartment size and the compartments of the second compartment size are a quarter of the size of the compartments of the first compartment size, the size of the compartment being the cross-sectional area thereof at right angles to the axis of the compartment, the framework being for use in making a support structure on a base.

11. A framework according to claim 10 which includes one or more rows of compartments with the first compartment size and one or more rows of compartments with the second compartment size.

12. A framework according to claim 11 which includes a row of compartments with a transitional size between a last row of compartments with the first compartment size and a first row of compartments with the second compartment size.

13. A framework according to claim 12 which includes one or more rows of compartments with a third compartment size, the compartments with the third compartment size being a quarter of the size of the compartments with the second compartment size, and the compartments with the second compartment size being one quarter of the size of the compartments with the first compartment size.

14. A framework according to claim 10 wherein the compartments have a square cross-section.

15. A framework according to claim 10 which includes a plurality of holes therethrough to permit drainage of any liquid substance through the holes from the framework.

* * * * *